United States Patent [19]

Hashikawa et al.

[11] Patent Number: 4,570,591

[45] Date of Patent: Feb. 18, 1986

[54] SYSTEM FOR CONTROLLING THROTTLING OF INTAKE AIR AND PRESSURE OF FUEL INJECTION IN DIESEL ENGINE

[75] Inventors: Atsushi Hashikawa, Okazaki; Tetsuro Kikuchi, Nishio; Kazutaka Katoh, Okazaki; Satosi Kuwakado, Nukata; Noriaki Kawai, Okazaki, all of Japan

[73] Assignees: Nippon Soken, Inc., Nishio; Toyota Jidosha Kabushiki Kaisha, Toyota, both of Japan

[21] Appl. No.: 689,373

[22] Filed: Jan. 7, 1985

[30] Foreign Application Priority Data

Jan. 13, 1984 [JP] Japan ..... 59-3549

[51] Int. Cl.[4] ..... F02M 39/00

[52] U.S. Cl. ..... 123/331; 123/458; 123/339; 123/394

[58] Field of Search ..... 123/331, 458, 330, 339, 123/332, 333, 394, 472, 344, 263

[56] References Cited

U.S. PATENT DOCUMENTS

| | | | |
|---|---|---|---|
| 4,186,692 | 2/1980 | Kawamura | 123/263 |
| 4,193,379 | 3/1980 | Dietrich | 123/263 |
| 4,327,695 | 5/1982 | Schechter | 123/500 |
| 4,361,121 | 11/1982 | Clemens | 123/332 |
| 4,365,600 | 12/1982 | Nakada | 123/339 |
| 4,367,709 | 1/1983 | Corrington | 123/339 |
| 4,424,876 | 1/1984 | Filho | 123/330 |
| 4,434,777 | 3/1984 | Straubel | 123/458 |
| 4,437,644 | 3/1984 | Wilmers | 123/472 |

FOREIGN PATENT DOCUMENTS

| | | | |
|---|---|---|---|
| 2092223 | 8/1982 | United Kingdom | 123/446 |

*Primary Examiner*—Carl Stuart Miller

*Attorney, Agent, or Firm*—Cushman, Darby & Cushman

[57] ABSTRACT

A system for controlling the throttling of intake air and pressure of fuel injection in a diesel engine, including an intake air throttling mechanism in an intake air passage and a fuel injection apparatus in a swirl chamber. The fuel injection pressure of the fuel injection apparatus is variable. The intake air throttling mechanism is operated in accordance with predetermined operating parameters of the engine to reduce the fuel injection pressure when necessary.

9 Claims, 10 Drawing Figures

SYSTEM FOR CONTROLLING THROTTLING OF INTAKE AIR AND PRESSURE OF FUEL INJECTION IN DIESEL ENGINE

BACKGROUND OF THE INVENTION (1.) Field of the Invention

The present invention relates to a system for controlling the throttling of intake air and the pressure of fuel injection in a diesel engine.

(2.) Description of the Related Art

Diesel engines are conventionally provided with mechanisms for throttling intake air so as to reduce engine vibration and noise to acceptable levels in a light load condition. Throttling of intake air, however, can have a detrimental effect on the combustion of fuel by the engines.

In diesel engines, the effectiveness of fuel combustion is governed by the conditions of fuel spray, e.g., the force of penetration of the fuel, the degree of atomization of the fuel, and the degree of mixing with the vortical air stream (swirl) in the combustion chamber. These are in turn determined by the fuel injection pressure, the swirl strength, and the position of the injection hole.

While the strength of the swirl is dependent upon the engine speed, it particularly declines upon throttling of the intake air. As a result, an increased amount of fuel strikes or adheres to the walls of the engine combustion chamber, preventing proper mixture with the air. This, as mentioned above, has a detrimental effect on the combustion of the fuel and results in increased emission of hydrocarbons and carbon monoxide and increased emission of white smoke.

SUMMARY OF THE INVENTION

It is a principal object of the present invention to provide a system for controlling the throttling of intake air and the pressure of fuel injection in a diesel engine so as to reduce emission of hydrocarbons, carbon monoxide, and white smoke even upon throttling of the intake air.

According to the present invention, the valve opening pressure of the fuel injection apparatus is made variable. When the intake air is throttled to reduce engine vibration and noise, the valve opening pressure of the fuel injection apparatus is reduced so as to lower the pressure of the fuel injection and thereby promote the mixture of the fuel with the air.

BRIEF DESCRIPTION OF THE INVENTION

The present invention will be more clearly understood from the description set forth below with reference to the accompanying drawings, wherein.

DESCRIPTION OF THE PREFERRED EMBODIMENTS

Figure 1:
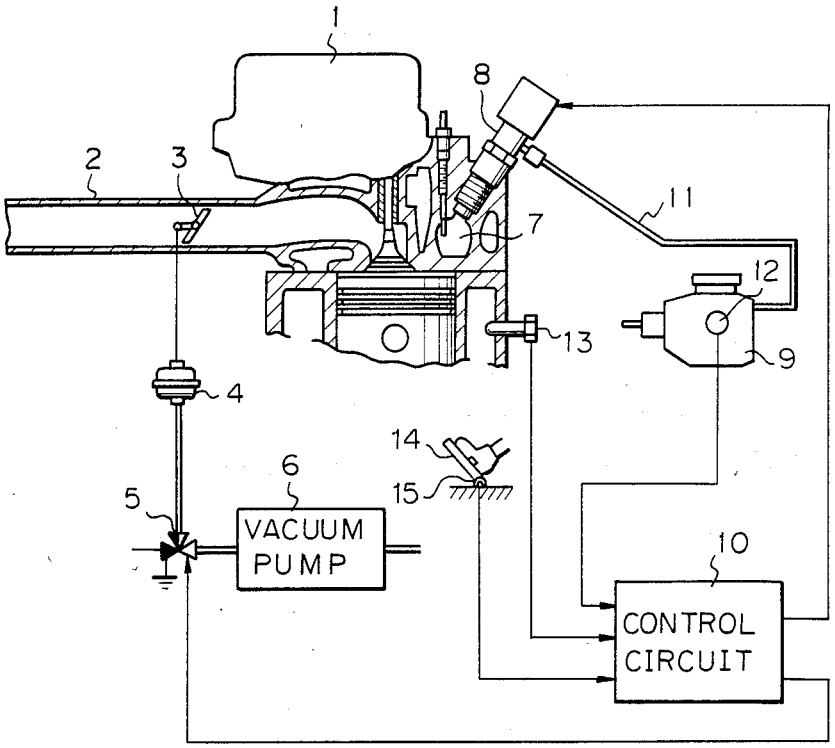
FIG. 1 is a schematic diagram of an embodiment of a diesel engine employing a system according to an embodiment of the present invention.

FIG. 1 is a schematic diagram of a diesel engine employing a system according to an embodiment of the present invention. In FIG. 1, an intake pipe 2 of an engine body 1 has disposed within it a valve 3 which is rotatably supported in the intake pipe 2 and is driven by an actuator 4 actuated by negative pressure. That is, the actuator 4 is actuated, via a solenoid valve 5, by a vacuum pump 6 as a negative pressure source actuated. A combustion chamber (swirl chamber) 7 has mounted on it a fuel injection apparatus 8 with a variable fuel injection valve opening pressure. The fuel injection apparatus 8 is supplied with fuel from a fuel injection pump 9 via a pipe 11. The fuel injection pump 9 has mounted on it an engine speed sensor 12 comprised of an electromagnetic pickup which generates a sine wave signal corresponding to the engine speed. The cylinder block of the engine body 1 has disposed in it an engine coolant sensor (thermistor) 13 which generates an analog signal corresponding to the engine coolant temperature. Reference numeral 14 designates an accelerator pedal having an accelerator switch 15. This accelerator switch 15 is turned on only when the accelerator pedal is not depressed.

The output signals of the engine speed sensor 12, the engine coolant sensor 13, and the accelerator switch 15 are supplied to a control circuit 10 which controls the solenoid valve 5 controlling the opening of the valve 3 and the valve opening pressure of the fuel injection apparatus 8.

Figure 2:
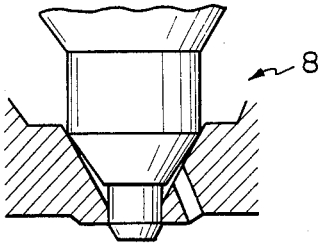
FIGS. 2 and 3 are partial cross-sectional views of a fuel injection apparatus of FIG. 1.
Figure 3:
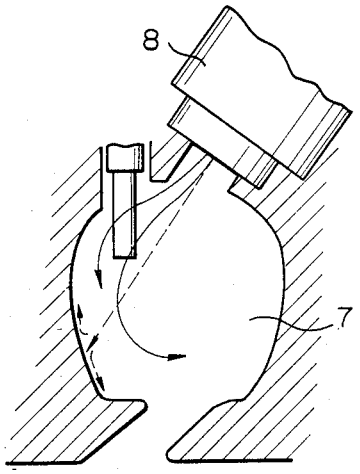

Referring to FIG. 2, the fuel injection apparatus 8 has a Pintaux nozzle with a main injection hole and a subinjection hole. The fuel injection is carried out mainly using the main injection hole when the valve opening pressure is high and mainly using the subinjection hole when the valve opening pressure is low. When the valve opening pressure is low, the fuel is sprayed as illustrated by the solid lines in FIG. 3. Therefore, amount of fuel in the swirl is increased and the amount of fuel adhered to the walls is decreased. Thus, the mixing of the fuel with the air is improved. This results in satisfactory fuel combustion and suppression of any increase in hydrocarbon, carbon monoxide, and white smoke emission. This further enables stronger throttling of the intake air for further reduction of engine vibration and noise.

Figure 4:
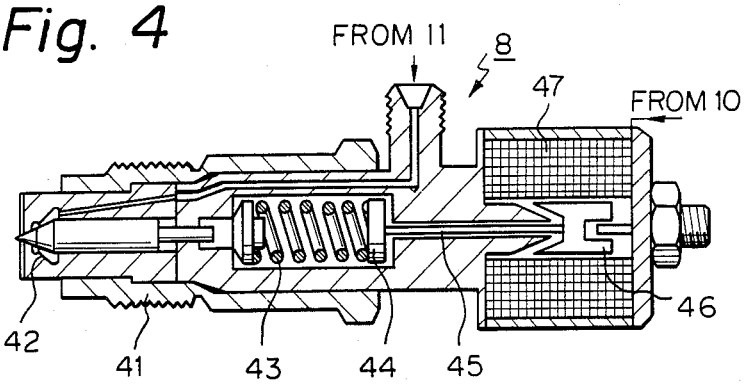
FIG. 4 is a cross-sectional view of the entire fuel injection apparatus of FIG. 1.

The overall configuration of the fuel injection apparatus 8 of FIG. 1 is illustrated in FIG. 4. As shown in FIG. 4, the fuel injection apparatus 8 includes a holder 41 encapsulating a nozzle 42, a spring 43, and a spring seat 44. To push the spring seat 44, a push rod 45 is provided. This is connected to a moving core 46 which is slidably located in a magnetic circuit formed by a coil 47. Thus, the valve opening pressure can be controlled by supplying a current to the coil 46.

Figure 5:
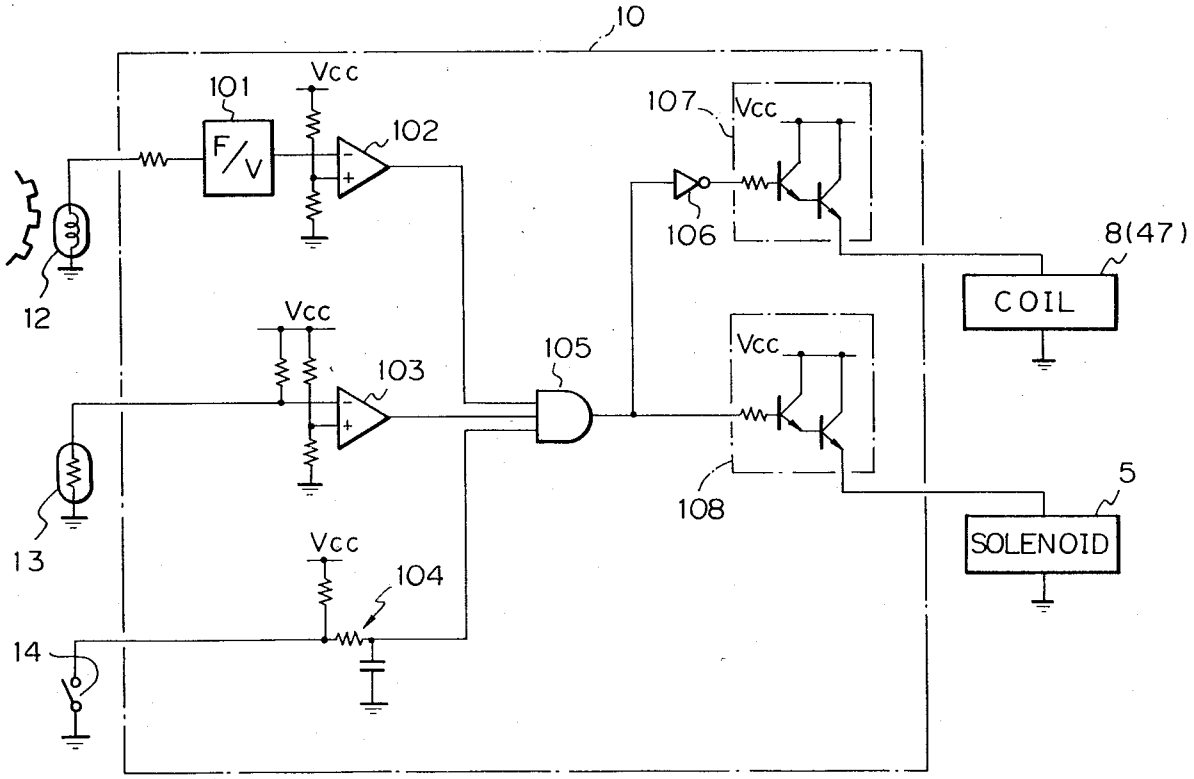
FIG. 5 ,is a detailed circuit diagram of a control circuit of FIG. 1.

FIG. 5 is a detailed circuit diagram of the control circuit 10 of FIG. 1. The output signal of the engine speed sensor 12 is supplied to a frequency-to-voltage converter circuit 101 which generates a voltage signal proportional to the engine speed. This voltage signal is applied to an input of a comparator 102. A reference voltage is applied to the other input thereof. The comparator 102 generates a signal of a high level ("1") when the engine speed is lower than a predetermined value, such as 700 rpm. Otherwise, the comparator 102 generates a signal of a low level ("0"). The output signal of the engine coolant sensor 13 is applied to an input of a comparator 103, while a reference voltage is applied to the other input thereof. The comparator 103 generates a signal of a high level when the engine coolant temperature is higher than a predetermined value which is, for example, 45 °to 60°C. Otherwise, the comparator 103 generates a signal of a low level. The output signal of the accelerator switch 14 is supplied to an integration circuit 104. The integration circuit 104 generates a signal of a high level when the accelerator is not depressed, and generates a signal of a low level when the accelerator is depressed. The output signals of the comparators 102 and 103 and the integration circuit 104 are applied to inputs of an AND circuit 105.

When all of the output signals of the comparators 102 and 103 and the integration circuit 104 are at a high level, the AND circuit 105 generates a signals of a high level, thereby carrying out an intake air throttling control operation. That is, in a hot engine state and in an idle state, the AND circuit 105 generates a signal of a high level so as to turn on a driver 108 formed, for example, by a Darlington circuit. As a result, the solenoid valve 5 of FIG. 1 is turned on, so that negative pressure is supplied from the vacuum pump 6 to the actuator 4. Thus, the valve 3 is operated to throttle the intake pipe 2. Simultaneously, the high level output signal of the AND circuit 105 is converted into a signal of a low level by an inverter 106 and is transmitted to a driver 107 which includes, for example, a Darlington circuit. As a result, the driver 107 is turned off, so that no current is supplied to the coil 47 (FIG. 4), whereby the spring 43 relaxes. Thus, the valve opening pressure of the nozzle 42 is reduced.

Contrary to the above, when one or more of the output signals of the comparators 102 and 103 and the integration circuit 104 is at a low level, the AND circuit 105 generates a signal of a low level. Therefore, the driver 108 is turned off to turn off the solenoid valve 5. Thus, no intake air throttling operation is carried out. Simultaneously, the driver 107 is turned on and a current is supplied to the coil 47. As a result, the moving core 46 associated with the push rod 45 pushes the spring 43. Thus, the valve opening pressure of the nozzle 42 is increased.

Figure 6:
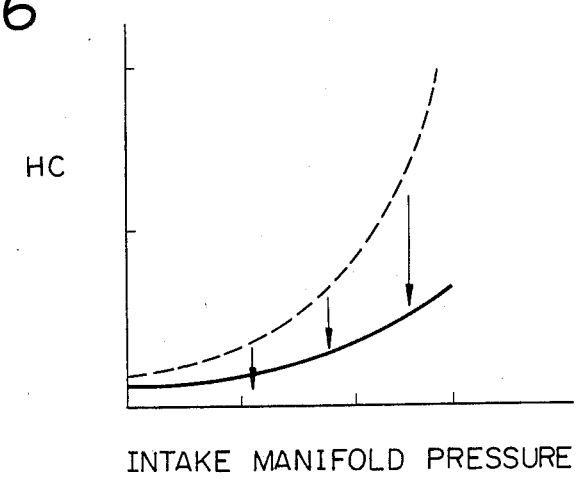
FIG. 6 is a graph for explaining the effect of the present invention.

During a normal engine speed mode, since the pressure within the combustion chamber and the swirl pressure are both large, satisfactory combustion is obtained even when the fuel injection apparatus 8 operates under a high fuel injection pressure. On the other hand, during an intake air throttling mode, the pressure within the combustion chamber and the swirl pressure are both remarkably reduced. Even in this case, however, since the fuel injection apparatus 8 operates under a low fuel injection pressure, the amount of fuel adhered to the walls of the combustion chamber is reduced, thereby obtaining satisfactory combustion. As a result, for example, hydrocarbon emissions are remarkably reduced, as shown in FIG. 6. Therefore, the intake air can be throttled even more for further reducing engine vibration and noise. Note that the dotted line of FIG. 6 represents the hydrocarbon emissions in the prior art.

Figure 7:
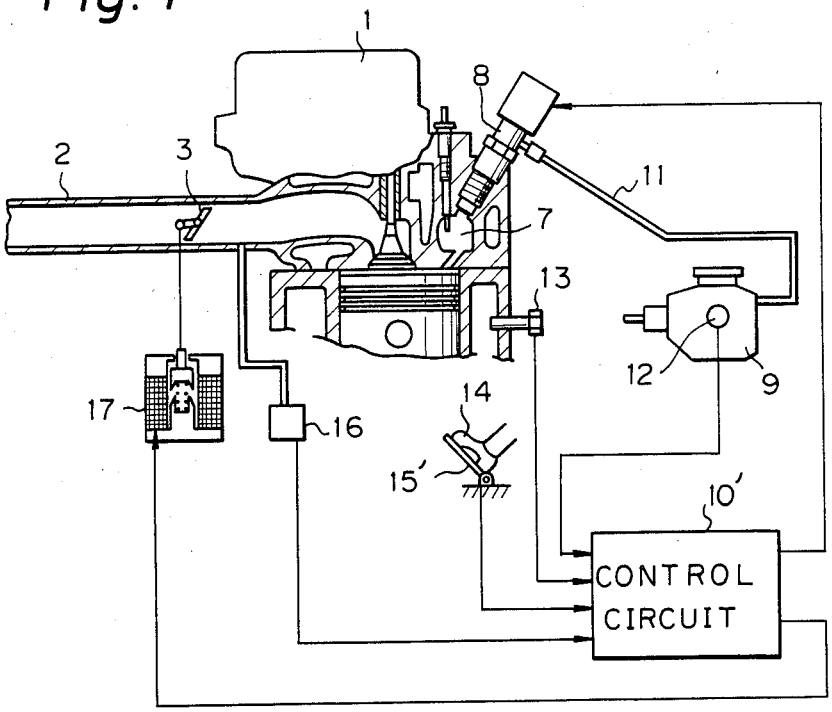
FIG. 7 is a schematic diagram of a diesel engine employing a system according to another embodiment of the present invention.

In FIG. 7, which illustrates a second embodiment of the present invention, an accelerator opening sensor 15' is provided instead of the accelerator switch 15 of FIG. 1. The accelerator opening sensor 15' generates an analog signal corresponding to the accelerator opening angle. Also provided in the intake pipe 2 is an intakeair pressure sensor 16 which generates an analog signal corresponding to the intake air pressure. Further, a linear solenoid 17 is provided instead of the actuator 4, the solenoid valve 5, and the vacuum pump 6 of FIG. 1. In the second embodiment illustrated in FIG. 7, continuous control of the intake air throttling and the valve opening pressure of the fuel injection apparatus 8 is possible.

Figure 8:
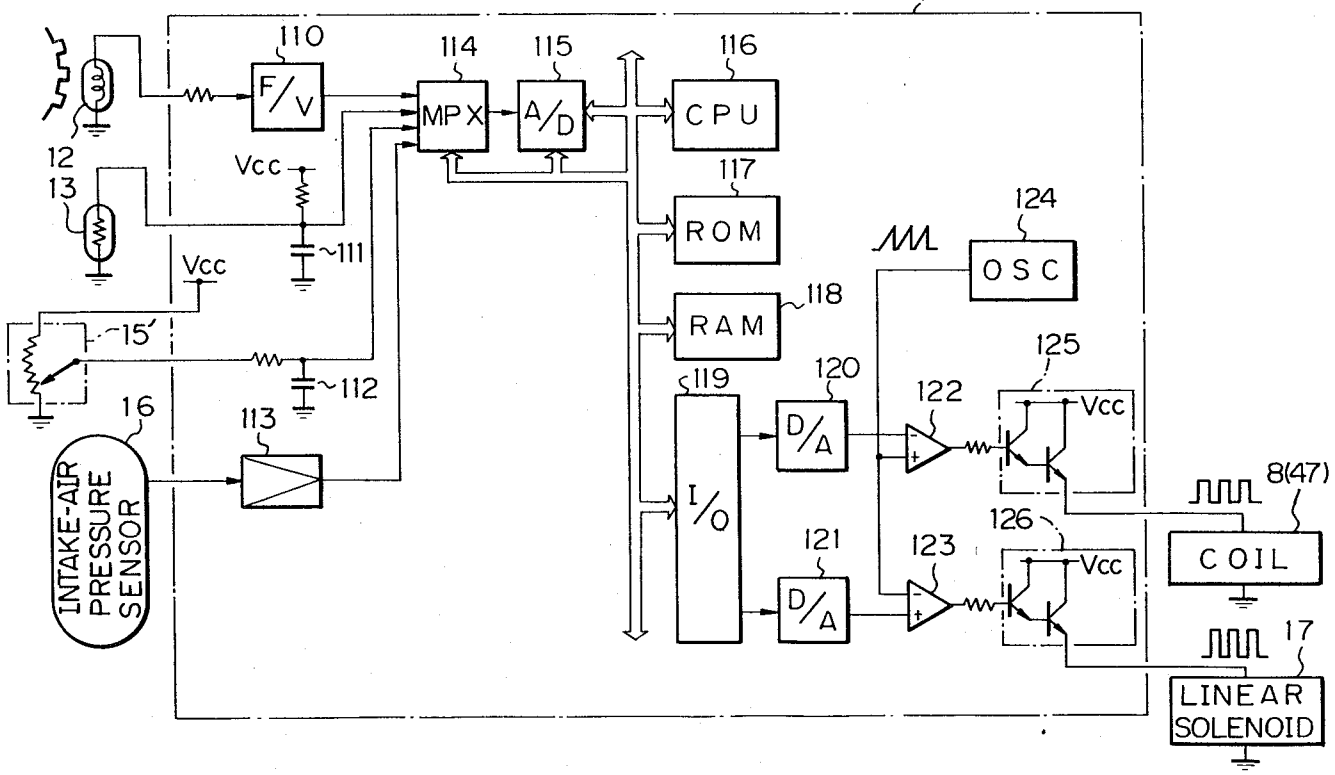
FIG. 8 is a detailed circuit diagram of a control circuit of FIG. 7.

In FIG. 8, which is a detailed circuit diagram of the control circuit 10' of FIG. 7, the output signal of the engine speed sensor 12 is supplied to a frequency-to-voltage conversion circuit 110 which generates a voltage signal corresponding to the engine speed and transmits it to a multiplexer 114. The output signal of the engine coolant sensor 13 is supplied via an integration circuit 111 to the multiplexer 114. The output signal of the accelerator opening sensor 15' is supplied via an integration circuit 112 to the multiplexer 114. The output signal of the intake air pressure sensor 16 is supplied via an amplifier 113 to the multiplexer 114. Each of the output signals is selected by the multiplexer 114 and is transmitted to an analog-to-digital (A/D) converter 115 which performs an A/D conversion upon the selected signals. After each A/D conversion, the A/D converter 115 transmits an interrupt signal to a central processing unit (CPU) 116. As a result, in an interrupt routine, the CPU 116 stores the current data of the engine speed sensor 12, the engine coolant sensor 13, the accelerator opening sensor 15', and the intake-air pressure sensor 16 in predetermined areas of a random access memory (RAM) 118.

A read-only memory (ROM) 117 stores various programs, constants, map data, and the like.

Valve opening pressure data and intake air throttling data calculated in the routine, as will be explained later, are transmitted to predetermined points of an input/output interface 119 and are then transmitted to digital-to-analog (D/A) converters 120 and 121, respectively. The analog output signals of the D/A converters 120 and 121 are transmitted to inputs of comparators 122 and 123, respectively, which also receive a triangular wave signal from a triangular wave oscillating circuit 124. As a result of the comparing operation by the comparators 122 and 123, the comparators 122 and 123 control drivers 125 and 126, respectively, thereby controlling the current supply to the coil 47 of the fuel injection apparatus 8 and the linear solenoid 17. In this case, pulse width modulation (PMW) control is performed upon the coil 47 of the fuel injection apparatus 8 and the linear solenoid 17.

The operation of the control circuit 10' of FIG. 7 will be explained with reference to FIG. 9. Step 901 is started every predetermined time period or crank angle. At step 902, the current analog data, i.e., the engine speed data by the engine speed sensor 12, the engine coolant temperature data by the engine coolant sensor 13, the accelerator angle data by the accelerator opening sensor 15', and the intake-air pressure data by the intake-air pressure sensor 16 are fetched and are stored in predetermined areas of the RAM 118. At step 903, the CPU 116 calculates an optimum intake air throttling value by a four-dimensional map stored in the ROM 117 based upon the above-mentioned current data. Then, at step 904, the CUP 116 sets the calculated optimum intake air throttling value in the D/A converter 121. As a result, this optimum value is converted by the comparator 123 into a pulse-width modulated signal which drives the linear solenoid 17 via the driver 126. At step 905, the CPU 116 calculates an optimum valve opening pressure based upon the optimum intake air throttling value, and at step 906, the CPU 116 sets the calculated optimum valve opening pressure in the D/A converter 120. As a result, this optimum value is converted by the comparator 122 into a pulsewidth modulated signal which drives the coil 47 of the fuel injection apparatus 8. Thus, the routine of FIG. 9 is completed by step 907.

Figure 9:
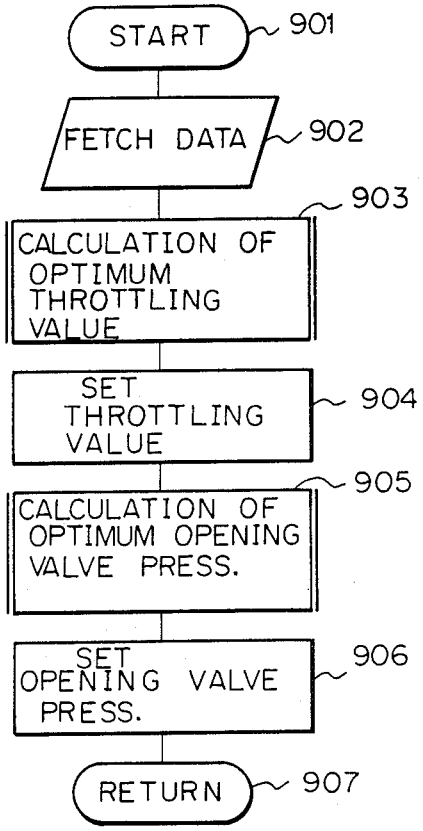
FIG. 9 is a flow chart of the operation of the control circuit of FIG. 7.

Note that the calculation map used at step 903 of FIG. 9 is determined based upon the following phenomena. First, when the intake air is strongly throttled during a low engine temperature state, the engine begins to misfire increasing vibration, noise, hydrocarbon, carbon monoxide, and white smoke emissions, and the like. Second, when the intake air is strongly throttled during a high engine speed state, the engine torque is remarkably reduced. Also, the calculation at step 905 of FIG. 9 is carried out in order to reduce the optimum valve opening pressure when the optimum intake air throttling is carried out.

Figure 10:
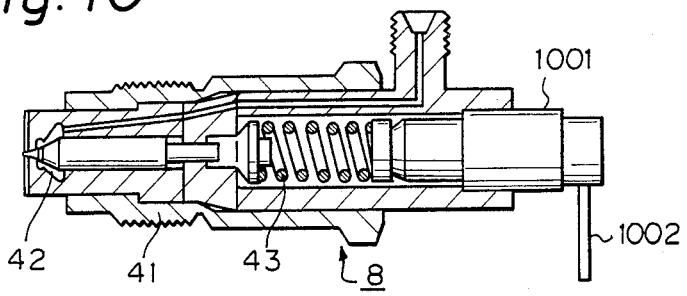
FIG. 10 is a cross-sectional view of another example of the fuel injection apparatus of FIGS. 1 and 7.

The valve opening pressure of the fuel injection apparatus 8 can be controlled by pushing the spring 43 with oil pressure. In addition, the opening valve pressure of the fuel injection apparatus can be controlled by directly changing the spring 43. For this purpose, as illustrated in FIG. 10, an adjusting screw 1001 for pushing the spring 43 and a set bar 1002 for rotating the screw 1001 are provided instead of the push rod 45, the moving core 46, and the coil 47 of FIG. 4.

As explained hereinbefore, according to the present invention, hydrocarbon, carbon monoxide, and white smoke emissions can be prevented from increasing even when the intake air is throttled.

We claim:

1. A system for controlling throttling of intake air in an intake air passage and pressure of fuel injection in a swirl chamber of a diesel engine, comprising:

an intake air throttling mechanism provided in said intake air passage;

a fuel injection apparatus provided in said swirl chamber, the valve opening pressure of said fuel injection apparatus being variable; and means for controlling said intake air throttling mechanism and said fuel injection apparatus, said control means reducing the valve opening pressure of said fuel injection apparatus when closing said intake air throttling in accordance with predetermined operating parameters of said engine.

2. A system as set forth in claim 1, wherein said fuel injection apparatus comprises a Pintaux nozzle.

3. A system as set forth in claim 1, wherein said control means comprises:

means for determining whether the speed of said engine is lower than a predetermined speed;

means for determining whether the coolant temperature of said engine is higher than a predetermined temperature;

means for determining whether an accelerator is depressed; and means for closing said intake air throttling mechanism and reducing the valve opening pressure of said fuel injection apparatus when the speed is lower than said predetermined speed, the coolant temperature is lower than said temperature and the accelerator is not depressed.

4. A system as set forth in claim 1, wherein said control means continuously closes said intake air throttling mechanism and continuously reduces the valve opening pressure of said fuel injection apparatus in accordance with the speed of said engine, the coolant temperature of said engine, the accelerator angle of said engine, and said intake-air pressure of said engine.

5. A system as set forth in claim 1, wherein said intake air throttling mechanism is controlled by activating an actuator using negative pressure.

6. A system as set forth in claim 4, wherein said intake air throttling mechanism is actuated by a linear solenoid.

7. A system as set forth in claim 1, wherein the valve opening pressure of said fuel injection apparatus is controlled by a linear solenoid.

8. A system as set forth in claim 1, wherein the valve opening pressure of said fuel injection apparatus is controlled by oil pressure.

9. A system as set forth in claim 1, wherein the valve opening pressure of said fuel injection apparatus is controlled by a screw.

* * * * *